US008235666B2

(12) United States Patent
Rosenkranz et al.

(10) Patent No.: US 8,235,666 B2
(45) Date of Patent: Aug. 7, 2012

(54) PROPELLER FOR A MARINE PROPULSION SYSTEM

(75) Inventors: Hans-Gunther Rosenkranz, Wantirna South (AU); Mark Frederick Armstrong, Pascoe Vale South (AU); Peter John Major, Richmond (AU)

(73) Assignee: Aimbridge Pty Ltd., Melbourne (AU)

( * ) Notice: Subject to any disclaimer, the term of this patent is extended or adjusted under 35 U.S.C. 154(b) by 1220 days.

(21) Appl. No.: 11/914,650

(22) PCT Filed: May 15, 2006

(86) PCT No.: PCT/AU2006/000640

§ 371 (c)(1),
(2), (4) Date: Feb. 5, 2008

(87) PCT Pub. No.: WO2006/130899

PCT Pub. Date: Dec. 14, 2006

(65) Prior Publication Data

US 2008/0166933 A1 Jul. 10, 2008

(30) Foreign Application Priority Data

Jun. 9, 2005 (AU) ..... 2005903028

(51) Int. Cl.
*B63H 3/02* (2006.01)

(52) U.S. Cl. ..... 416/155; 416/220 R; 416/219 A

(58) Field of Classification Search ..... 416/155, 416/163, 167, 168 R, 207, 208, 220 R, 219 A; 440/50

See application file for complete search history.

(56) References Cited

U.S. PATENT DOCUMENTS

| | | | | |
|---|---|---|---|---|
| 2,514,097 | A | 7/1950 | Sharp | 170/160.23 |
| 2,523,053 | A | 9/1950 | Obrist | 60/52 |
| 2,885,013 | A * | 5/1959 | Steiner | 416/163 |
| 2,981,338 | A | 4/1961 | Hindmarch | 170/160.6 |
| 3,099,321 | A * | 7/1963 | Watts | 416/140 |
| 3,876,331 | A * | 4/1975 | DenHerder et al. | 416/93 R |
| 4,150,921 | A | 4/1979 | Wennberg | 416/207 |
| 4,417,852 | A | 11/1983 | Costabile et al. | 416/2 |
| 4,643,643 | A | 2/1987 | Otto | 416/154 |
| 5,028,210 | A * | 7/1991 | Peterson et al. | 416/164 |
| 6,688,926 | B1 | 2/2004 | Willmot | 440/50 |
| 7,156,707 | B2 * | 1/2007 | Rosenkranz et al. | 440/50 |

FOREIGN PATENT DOCUMENTS

| | | | |
|---|---|---|---|
| SU | 477052 | A | 7/1975 |
| WO | WO 2005/012078 | A1 | 2/2005 |

OTHER PUBLICATIONS

*International Search Report*, International Application No. PCT/AU2006/000640; Date of Mailing: Aug. 1, 2006.

* cited by examiner

*Primary Examiner* — Ninh H Nguyen
(74) *Attorney, Agent, or Firm* — Sunstein Kann Murphy & Timbers LLP

(57) ABSTRACT

A propeller for a marine propulsion system is disclosed which comprises a propeller hub having a casing formed from three segments (16*a*, 16*b*, 16*c*), each of which has a part of an opening (28) for mounting a propeller blade (34). A locking and unlocking mechanism (51, 54, 95, 100) is provided for disengaging the propeller blades to enable pitch adjustment of the blades. A push rod (50) is connected to the mechanism (100) to cause disengagement and adjustment of the pitch of the blades. The mechanism (100) includes a claw (101) having pivotally connected fingers (95). The hub also has a slide ring (51) having a load surface (61) is provided for receiving load when the propeller blades are unlocked to enable pitch adjustment to take place.

6 Claims, 3 Drawing Sheets

PROPELLER FOR A MARINE PROPULSION SYSTEM

FIELD OF THE INVENTION

This invention relates to a variable pitch propeller for a marine propulsion system. The invention is an improvement to that disclosed in our International Application No. PCT/AU2004/001721. The contents of that International application are incorporated into this specification by this reference.

BACKGROUND ART

Marine propulsion systems generally comprise outboard motors or stern drive systems which transmit rotary power to a propeller to drive a boat through water. The propeller includes propeller blades which are angled to provide propulsion through the water. The angle or pitch of the blades relative to a radial axis transverse to the drive axis of the propeller is generally fixed and selected to provide maximum efficiency at maximum speed or cruise speed of the boat to which the system is used. The pitch is generally less efficient at take-off when the boat is driven from stationary up to the cruise speed, which inefficiency results in increased fuel consumption and a longer time for the boat to move from the stationary to cruise speed. If the propeller has too large pitch, the power of the engine may not be sufficient to accelerate the boat to planing speed.

In order to overcome this problem, variable pitch propeller systems have been proposed in which the pitch of the propeller blades can be altered to suit the changing operating conditions of the propulsion system.

Our aforementioned International application discloses a propeller which successfully addresses the above problems.

SUMMARY OF THE INVENTION

The object of the present invention is to provide a propeller which provides still further advantages over conventional variable pitch propeller systems.

The invention provides a variable pitch propeller for a marine propulsion system, comprising:

- a propeller hub having a plurality of openings, and a hub surface surrounding each opening;
- a propeller blade having a propeller base mounted in each of the openings, each base having a base surface for engaging the hub surface of the respective opening;
- an unlocking mechanism for disengaging the respective base surface of the base from the respective hub surface of the hub for enabling rotation of the hub about an axis transverse to a rotation axis of the hub;
- a pitch adjusting mechanism for rotating each base to thereby adjust the pitch of the propeller blade;
- a propeller hub casing formed from a plurality of separate segments, each of the segments having a part of one of said plurality of openings, and said segments being couplable together to form the propeller hub casing.

By providing a propeller hub casing formed from a plurality of segments, the assembly of the unlocking mechanism and pitch adjusting mechanism within the hub is easier, thereby improving the ease of manufacture and reducing manufacturing costs.

Preferably the hub segments are arcuate in shape so that when the hub segments are coupled together, their outer surfaces form a cylinder, each segment having a tongue at one end and a cut-out at the opposite end, the cut-out defining at least one lug, the tongue and the at least one lug having a bore, and wherein the tongue of one segment engages in the cut-out of an adjacent segment so that the bores in the tongue and lug align, and a pin located through the aligned bores to couple the segments together to form the hub casing.

Preferably the cut-out is arranged at a midpoint of one end and defines a pair of spaced apart lugs, each having an aligned bore.

Preferably the unlocking mechanism comprises a mechanical unlocking mechanism.

Preferably the propeller further comprises a mechanical re-locking mechanism for allowing re-engagement of the respective base surface of the base with the respective hub surface of the hub to lock the base in the pitch adjusted position.

Preferably the unlocking mechanism and the re-locking mechanism comprise a common locking and unlocking mechanism.

Preferably the re-locking mechanism allows re-engagement of the base surface with the hub surface by virtue of centrifugal force during operation of the propeller after the pitch adjusting mechanism has adjusted the pitch of the propeller blades.

Preferably the common locking and unlocking mechanism comprise a stem forming part of each base, a respective eccentric coupled to each stem, a respective pin mounted to each eccentric, a push rod for moving the pins to in turn rotate the eccentrics so that the eccentrics push the stems, and therefore the bases, radially inwardly with respect to the hub to unlock the base by removing load from the hub surface and base surface, and after the pitch of the propeller blades have been adjusted, re-applies the load to the surfaces to re-engage the respective base surface of the bases with the respective hub surfaces of the openings to re-lock the bases and therefore the propeller blades in the pitch adjusted position.

Preferably the mechanical unlocking mechanism disengages the respective base surface from the respective hub surface by transferring load from the base surface and hub surface to thereby allow the hub surface and base surface to move relative to one another.

Preferably the propeller base comprises a stem of the propeller blade and a base ring located on the stem, the base ring having the base surface.

Preferably the hub surface is formed on a hub ring which defines a part of a respective opening and which receives the base surface.

Preferably the base surface and hub surface are inclined surfaces which taper inwardly from a radially outermost edge of the surface to a radially most inner edge of the surfaces.

Preferably the unlocking mechanism comprises an eccentric, a slide ring having a slide surface mounted on the eccentric, the slide ring being arranged radially inwardly of the respective hub surface and base surface and located in a shoulder in the base ring so that when the eccentric is rotated, load is transferred from the respective hub surface and base surface to the hub ring and slide surface so the respective propeller blades can be adjusted after the transfer of load with the hub ring sliding on the slide surface.

Preferably the eccentric is coupled to a pin for firstly rotating the eccentric about a first axis to transfer the load and then rotating the eccentric about a second axis transverse to the first axis to rotate the respective propeller blade to adjust the pitch of the propeller blade.

Preferably the hub surface and the base surface are inclined cone-shaped surfaces.

Preferably the push rod is coupled to a claw which has a respective finger for each of the propeller blades, each finger being mounted to a respective pin by a socket and eye joint.

Preferably the fingers are pivotally coupled to the arms for pivotal movement relative to the arms.

The invention also provides a variable pitch propeller for a marine propulsion system, comprising:

a propeller hub having a plurality of openings, and a hub surface surrounding each opening;

a propeller blade having a propeller base mounted in each of the openings, each base having a base surface for engaging the hub surface of the respective opening;

a pitch adjusting mechanism for adjusting the pitch of each of the propeller blades about an axis perpendicular to a rotation axis of the hub, the mechanism including a plurality of generally radially extending arms, each arm carrying a finger, a pivotal coupling between the finger and the respective radially extending arm for allowing pivotal movement of the fingers with respect to the arms; and the arms being coupled to the propeller blades so that upon longitudinal movement of the arms in the direction of the axis of rotation of the hub, the pitch of the propeller blades is adjusted.

By making the arms pivotally connected to the fingers, the transfer of motion from the arms to the fingers and then to adjust the pitch of the propeller blades is smoother and involves no sliding action of the end of the fingers remote from the pivotal coupling, thereby providing more reliable pitch adjustment.

Preferably the hub has a hub casing formed from segments which are arcuate in shape so that when the hub segments are coupled together, they form a cylinder, each segment having a tongue at one end and a cut-out at the opposite end, the cut-out defining at least one lug, the tongue and at least one lug having a bore, and wherein the tongue of one segment engages in the cut-out of the adjacent segment so that the bores in the tongue and lug align and a pin located through the aligned bores to couple the segments together to form the hub casing.

Preferably the cut-out is arranged at a midpoint of one end and defines a pair of spaced apart lugs, each having an aligned bore.

Preferably the pitch adjusting mechanism has a mechanical unlocking mechanism.

Preferably the propeller further comprises a mechanical re-locking mechanism for allowing re-engagement of the respective base surface of the base with the respective hub surface of the hub to lock the base in the pitch adjusted position.

Preferably the unlocking mechanism and the re-locking mechanism comprise a common locking and unlocking mechanism.

Preferably the re-locking mechanism allows re-engagement of the base surface with the hub surface by virtue of centrifugal force during operation of the propeller after the pitch adjusting mechanism has adjusted the pitch of the propeller blades.

Preferably the common locking and unlocking mechanism comprise a stem on each base, a respective eccentric coupled to each stem, a respective pin mounted to each eccentric, a push rod attached to a claw which carries the arms and the fingers for moving the pins to in turn rotate the eccentrics so that the eccentrics push the stems, and therefore the bases, radially inwardly with respect to the hub to unlock the base by removing load from the hub surface and base surface, and after the pitch of the propeller blades have been adjusted, re-applies the load to the surfaces to re-engage the respective base surface of the bases with the respective hub surfaces of the openings to re-lock the bases and therefore the propeller blades in the pitch adjusted position.

Preferably the mechanical unlocking mechanism disengages the respective base surface from the respective hub surface by transferring load from the base surface and hub surface to thereby allow the hub surface and base surface to move relative to one another.

Preferably the propeller base comprises a stem of the propeller blade and a base ring located on the stem, the base ring having the base surface.

Preferably the hub surface is formed on a hub ring which defines a part of a respective opening and which receives the base surface.

Preferably the base surface and hub surface are inclined surfaces which taper inwardly from a radially outermost edge of the surface to a radially most inner edge of the surfaces.

Preferably the unlocking mechanism comprises an eccentric, a slide ring having a slide surface mounted on the eccentric, the slide ring being arranged radially inwardly of the respective hub surface and base surface so that when the eccentric is rotated, load is transferred from the respective hub surface and base surface to the hub ring and slide surface so the respective propeller blades can be adjusted after the transfer of load with the hub ring sliding on the slide surface.

Preferably the eccentric is coupled to a pin for firstly rotating the eccentric about a first axis to transfer the load and then rotating the eccentric about a second axis transverse to the first axis to rotate the respective propeller blade to adjust the pitch of the propeller blade.

Preferably the hub surface and the base surface are inclined cone-shaped surfaces.

Preferably each finger is mounted to a respective pin by a socket and eye joint.

The invention also may be said to reside in a variable pitch propeller for a marine propulsion system, comprising:

a propeller hub;

a plurality of openings in the hub, each for receiving a respective propeller blade;

a hub ring for each of the propeller blades, the hub rings each forming a part of a respective said opening and having a hub surface;

a base ring on each propeller blade and having a base surface for engaging a respective hub surface;

a slide member having a load surface;

a locking and unlocking mechanism for unlocking the propeller blade by transferring load from the base surface and hub surface to the base ring and load surface to unlock the blades and for locking the blades by retransferring load to the base surface and hub surface after the propeller blade has been adjusted in pitch; and a pitch adjusting mechanism for rotating the blades about transverse axes with respect to the axis of rotation of the propeller when the propeller is in the unlocked condition and the load has been transferred to the base ring and load surface.

Preferably the slide member comprises a slide ring and has a radially outer surface which forms the load surface for engaging a surface on the base ring so that load is taken by the base ring and load surface when the propeller blade is unlocked.

Preferably the base surface and hub surface are inclined conical surfaces.

Preferably the unlocking mechanism and the re-locking mechanism comprise a common locking and unlocking mechanism.

Preferably the re-locking mechanism allows re-engagement of the base surface with the hub surface by virtue of centrifugal force during operation of the propeller after the pitch adjusting mechanism has adjusted the pitch of the propeller blades.

Preferably each propeller blade has a base which includes the base ring, the common locking and unlocking mechanism comprise a stem on each base, a respective eccentric coupled to each stem, a respective pin mounted to each eccentric, a push rod attached to a claw which carries the arms and the fingers for moving the pins to in turn rotate the eccentrics so that the eccentrics push the stems, and therefore the bases, radially inwardly with respect to the hub to unlock the base by removing load from the hub surface and base surface, and after the pitch of the propeller blades have been adjusted, re-applies the load to the surfaces to re-engage the respective base surface of the bases with the respective hub surfaces of the openings to re-lock the bases and therefore the propeller blades in the pitch adjusted position.

BRIEF DESCRIPTION OF THE DRAWINGS

A preferred embodiment of the invention will be described, by way of example, with reference to the accompanying drawings in which.

DETAILED DESCRIPTION OF THE PREFERRED EMBODIMENT

Figure 1:
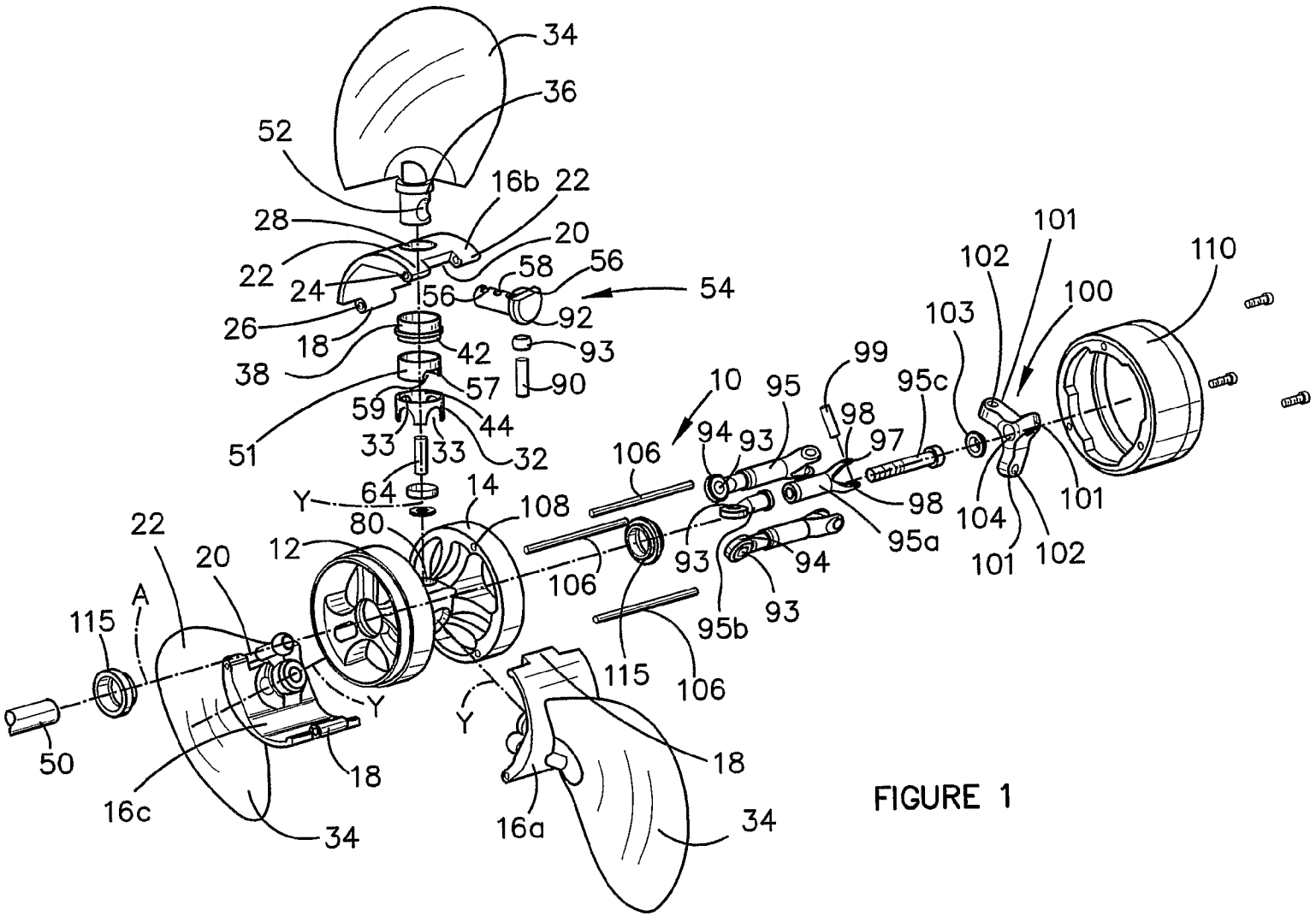
FIG. 1 is an exploded view of a hub according to the preferred embodiment of the invention.
Figure 2:
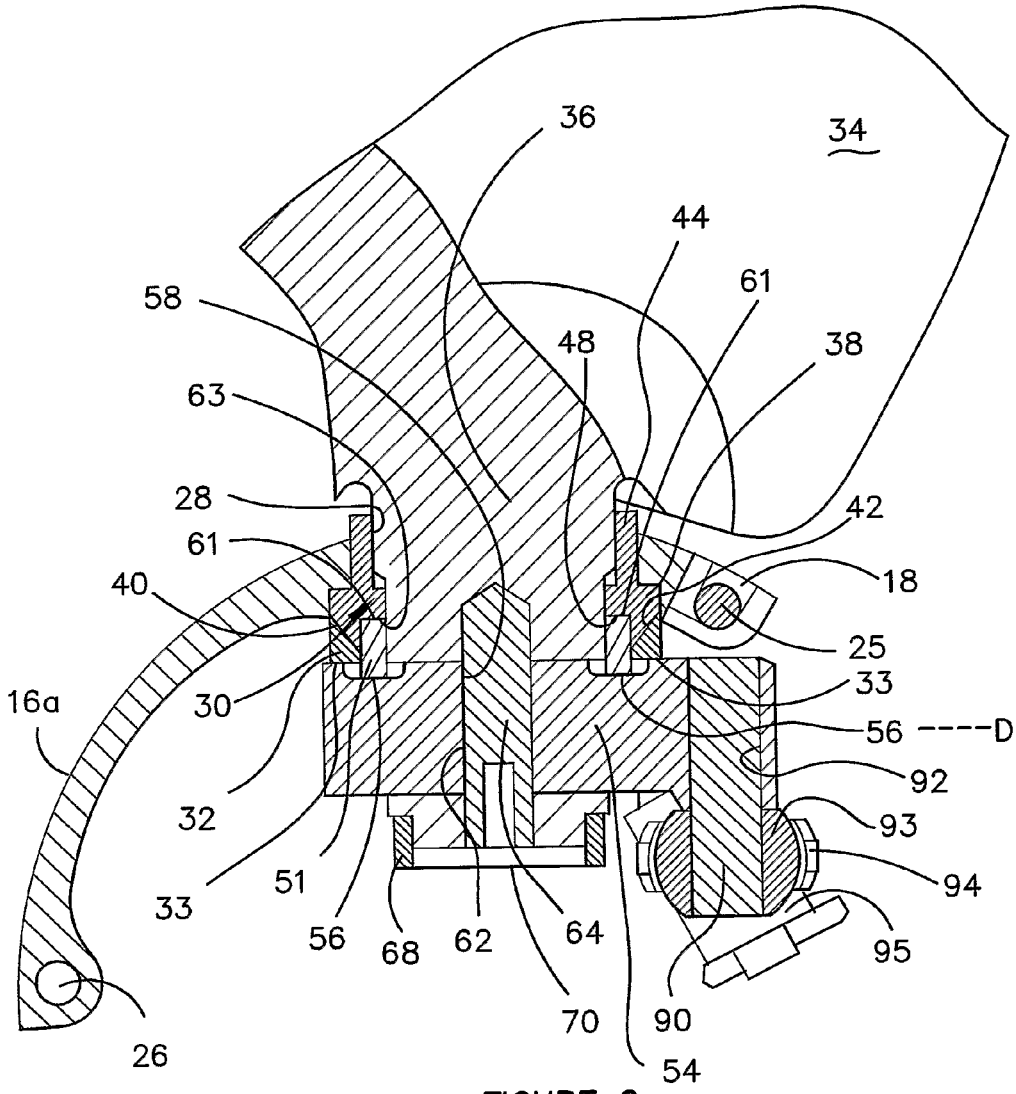
FIG. 2 is a cross-sectional view through one of the propeller blades showing the mechanical unlocking mechanism and pitch adjustment mechanism in an assembled condition.

With reference to FIGS. 1 and 2, a propeller hub 10 is shown. The hub 10 is driven by a drive shaft in the manner which is described in detail in the aforementioned International application. Unlocking of the propellers and pitch adjustment is controlled by a push rod 50 which is concentrically arranged within the drive shaft (not shown). The drive shaft (not shown) engages in splines provided in hub end 12 for rotating the hub 10 about a longitudinal axis shown by dashed line A.

Propeller blades 34 are provided which are adjustable in pitch about axes Y which are perpendicular to the axis A so as to adjust and set the pitch of the propeller blades 34 depending on the operating conditions of the boat and motor (not shown) which drives the drive shaft (not shown).

The hub 10 has a rear hub end 14 and a hub casing formed from three segments 16*a*, 16*b* and 16*c*. The segments are each arcuate in shape and have a tongue 18 at one end and a cut-out 20 at the opposite end. The cut-out 20 defines a pair of lugs 22. The lugs 22 are provided with an aligned bore 24 and the tongue 28 has a bore 26.

Each of the casing segments 16*a* to 16*c* is provided with a hole 28 which forms part of a hub opening 30 (best shown in FIG. 2).

The remainder of the opening 30 is defined by a hub ring 32 so that the peripheral edge of the hole 28 and the inner peripheral edge of the ring 32 form the opening 30.

Each propeller blade 34 has a base defined by a stem 36 and a base ring 38 which locates on the stem 36.

Figure 3:
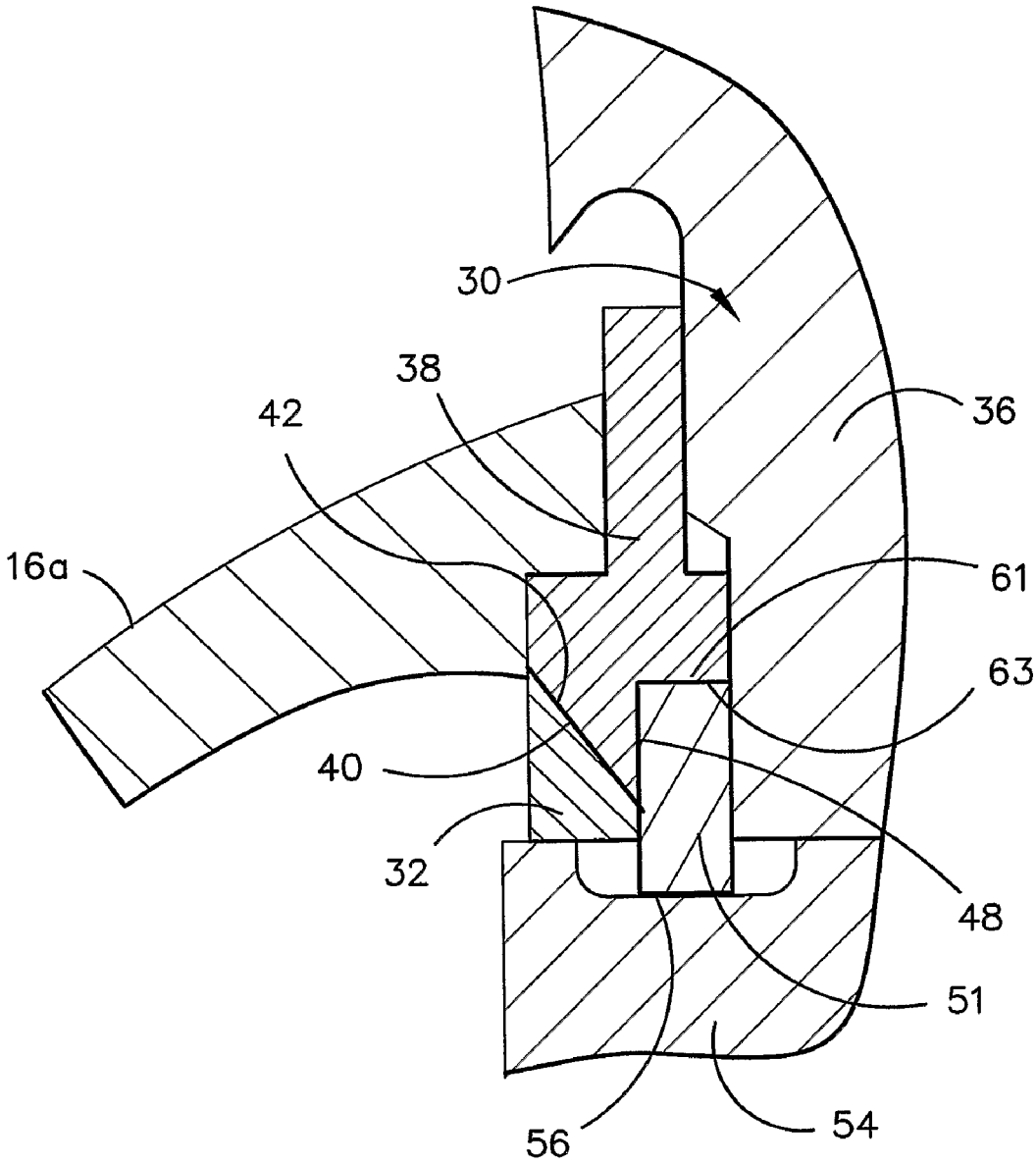
FIG. 3 is a view of part of FIG. 2 on an enlarged scale.

As best seen in FIGS. 2 and 3, hub ring 32 has an inclined hub surface 40 which tapers inwardly from a radially outermost edge to a radially innermost edge. The base ring 38 is provided with an inclined base surface 42 which tapers inwardly from an outermost edge to an innermost edge and which engages with the base surface 40. Thus, the surface 40 and 42 are conical in shape.

The base ring 38 is provided with an outer cylindrical section 44 which engages the stem 36 and an inner right angle shoulder 48, which are best seen in FIGS. 2 and 3.

A slide ring 51 locates in the shoulder 48 and about the stem 36.

Each stem 36 is provided with a bore 52 and an eccentric shaft 54 passes through the bore 36. The eccentricity of the shaft 54 is defined by cut-out or flattened sections 56 on the shaft 54 which receive surfaces 57 defined by cut-outs 59 (only one set shown in FIG. 1) of the slide ring 51. The hub ring 32 has arcuate cut-outs 33 which locate over the eccentric shaft 54. In FIG. 1, four arcuate cut-outs are shown to make it easier to locate the eccentric shaft on an aligned pair of the cut-outs. However, only two of the cut-outs are needed in order for the hub ring 32 to sit on the eccentric shaft 54. The shaft 54 is also provided with an elongate central hole 58 and the end of the stem 36 is provided with a bore 62 (see FIG. 2) so that a pin 64 can pass through the hole 58 and into the bore 62.

The stem 36 is journaled in a bushing or bearing 68 and a spring washer 70, such as a Bellville washer, elastic or plastic ring, is located at the end of the stem 36 for biasing the stem 36 radially outwardly. The Bellville washer 70 sits against a central support section 80 (see FIG. 1) of the hub between the hub ends 12 and 14.

Each of the eccentric shafts 54 has a pin 90 which locates in a bore 92. The pin 90 locates in an eye 93 rotatably supported in outer ring 94 of finger 95. The finger 95 is formed from a finger base part 95*a*, an end part 95*b* which carries the ring 94 and a screw 95*c* which locates through the base part 95*a* and screws into the part 95*b* to join the parts 95*a* and 95*b* together. Each finger has a bifurcated portion 97 having aligned openings 98 which receive a pivot pin 99. A claw 100 having three arms 101 is provided, each of the arms 101 has a hole 102 for receiving the pin 99 so as to pivotally connect the fingers 95 to the respective arm 101.

A bush 103 locates in central opening 104 of the claw 100 and receives the end of the push rod 50 for connecting the push rod 50 to the claw 100 and preventing the push rod from passing all the way through the claw 100 and to limit the travel of the pushrod in a drive shaft (not shown). Washers 115 locate in hub end pieces 12 and 14 to also support the drive shaft (not shown).

In order to form the hub casing, the segments 16*a* to 16*c* locate between the ends 12 and 14 with the tongue 18 of one segment locating in the cut-out 20 of an adjacent segment. Pins 106 pass through holes 108 in the hub end 14 and through aligned bores 24, as well as the bore 26 of the tongue 18 which locates in the respective cut-out 20 to join the segments 16*a* and 16*c* together and also couple them to the end 14. The pins 106 located in bores (not shown) in the other hub end 12 and a hub exhaust outlet end 110 screws onto the end 14 to lock the pins 106 in place and prevent them from being retracted.

In order to adjust the pitch of the propeller blade 34, the push rod 50 moves either to the right or left in FIG. 1 to in turn move the claw 100. Movement of the claw 100 moves the fingers 95. The longitudinal movement of the fingers 95 will tilt the pin 90 into or out of the plane of the paper in FIG. 2 and therefore rotate the shaft 54 about the longitudinal axis D of the shaft 54. The amount of rotation of the shaft about the longitudinal axis D is limited by the movement of the pin 64 relative to the arcuate slot 58 through the shaft 54. Rotation of the shaft 54 will pull the stem 36 radially inwardly allowing the ring 32 move radially inwardly so that load between the surfaces 42 and 40 is removed. Continued movement of the fingers 95 will then rotate the stem 36 about the axis Y in FIG. 1 to thereby rotate the blade 34 and adjust the pitch of the blade 34.

The rotation of the eccentric shaft 54 pulls the stem 36 radially inwardly very slightly and in the order of about 1/10 of a millimetre. This movement removes the load from the surfaces 40 and 42 and transfers the load to the load carrying surface 61 of shoulder 48 and load surface 63 on the sliding ring 51 which run on a slightly smaller radius than the surfaces 40 and 42. The movement of the surfaces 40 and 42 relative to one another during adjustment of the pitch of the propeller blade 34 is a sliding movement on one another with very little, if any, spacing between the surfaces. This is advantageous because it prevents sand and other small particles from entering the mechanism between the surfaces 40 and 42.

When adjustment has been completed, centrifugal forced acting on the propeller blade 34 tends to push the blade 34 outwardly so that the eccentric shaft 54 and pin 90 can move slightly, allowing the load to be retransferred to the surfaces 40 and 42 to lock the propeller blade in the pitch adjusted position. The spring 70 may facilitate some of the return movement of the eccentric shaft 54 and pin 90.

Since modifications within the spirit and scope of the invention may readily be effected by persons skilled within the art, it is to be understood that this invention is not limited to the particular embodiment described by way of example hereinabove.

In the claims which follow and in the preceding description of the invention, except where the context requires otherwise due to express language or necessary implication, the word "comprise", or variations such as "comprises" or "comprising", is used in an inclusive sense, i.e. to specify the presence of the stated features but not to preclude the presence or addition of further features in various embodiments of the invention.

The invention claimed is:

1. A variable pitch propeller for a marine propulsion system, comprising:

a propeller hub; a plurality of openings in the hub, each for receiving a respective propeller blade;

a hub ring for each of the propeller blades, the hub rings each forming a part of a respective said opening and having a hub surface;

a base ring on each propeller blade and having a base surface for engaging a respective hub surface;

a slide member having a load surface;

a locking and unlocking mechanism for unlocking the propeller blade by transferring load from the base surface and hub surface to the base ring and load surface to unlock the blades and for locking the blades by retransferring load to the base surface and hub surface after the propeller blade has been adjusted in pitch; and a pitch adjusting mechanism for rotating the blades about transverse axes with respect to the axis of rotation of the propeller when the propeller is in the unlocked condition and the load has been transferred to the base ring and load surface.

2. The propeller of claim 1 wherein the slide member comprises a slide ring and has a radially outer surface which forms the load surface for engaging a surface on the base ring so that load is taken by the base ring and load surface when the propeller blade is unlocked.

3. The propeller of claim 1 wherein the base surface and hub surface are inclined conical surfaces.

4. The propeller of claim 1 wherein the unlocking mechanism and the re-locking mechanism comprise a common locking and unlocking mechanism.

5. The propeller of claim 1 wherein the re-locking mechanism allows re-engagement of the base surface with the hub surface by virtue of centrifugal force during operation of the propeller after the pitch adjusting mechanism has adjusted the pitch of the propeller blades.

6. The propeller of claim 1 wherein each propeller blade has a base which includes the base ring, the common locking and unlocking mechanism comprise a stem on each base, a respective eccentric coupled to each stem, a respective pin mounted to each eccentric, a push rod attached to a claw which carries the arms and the fingers for moving the pins to in turn rotate the eccentrics so that the eccentrics push the stems, and therefore the bases, radially inwardly with respect to the hub to unlock the base by removing load from the hub surface and base surface, and after the pitch of the propeller blades have been adjusted, re-applies the load to the surfaces to re-engage the respective base surface of the bases with the respective hub surfaces of the openings to re-lock the bases and therefore the propeller blades in the pitch adjusted position.

* * * * *